US008864424B2

(12) United States Patent
Jones et al.

(10) Patent No.: US 8,864,424 B2
(45) Date of Patent: Oct. 21, 2014

(54) DEBRIS SHIELD FOR GEOCONTAINERS, METHOD OF MAKING, AND METHOD OF USE THEREOF

(75) Inventors: David Michael Jones, Dacula, GA (US); Tommy Spikes, Commerce, GA (US); Chris Timpson, Pendergrass, GA (US)

(73) Assignee: Nicolon Corporation, Pendergrass, GA (US)

( * ) Notice: Subject to any disclaimer, the term of this patent is extended or adjusted under 35 U.S.C. 154(b) by 211 days.

(21) Appl. No.: 13/031,876

(22) Filed: Feb. 22, 2011

(65) Prior Publication Data

US 2011/0206458 A1 Aug. 25, 2011

Related U.S. Application Data

(60) Provisional application No. 61/306,215, filed on Feb. 19, 2010.

(51) Int. Cl.

| | |
|---|---|
| ***E02D 17/20*** | (2006.01) |
| ***D03D 1/00*** | (2006.01) |
| ***D03D 15/00*** | (2006.01) |
| ***D03D 15/04*** | (2006.01) |
| ***D03D 13/00*** | (2006.01) |
| ***D03D 3/02*** | (2006.01) |
| ***D03D 11/00*** | (2006.01) |

(52) U.S. Cl.

CPC ..... *D03D 11/00* (2013.01); *D10B 2321/021* (2013.01); *D03D 1/0041* (2013.01); *D10B 2331/301* (2013.01); *D10B 2331/061* (2013.01); *D10B 2321/10* (2013.01); *D03D 15/00* (2013.01); *D10B 2331/02* (2013.01); *D03D 15/04* (2013.01); *D03D 13/008* (2013.01); *D03D 3/02* (2013.01); *D10B 2505/204* (2013.01); *D10B 2401/22* (2013.01); *D10B 2331/14* (2013.01); *D10B 2321/022* (2013.01); *D10B 2331/021* (2013.01); *D03D 15/0083* (2013.01); *D10B 2401/041* (2013.01); *D03D 1/007* (2013.01)

USPC ..... 405/302.7; 405/15; 405/21; 405/302.6; 442/239; 442/243

(58) Field of Classification Search

USPC ..... 405/15, 16, 21, 30, 32, 302.4, 302.6, 405/302.7; 428/36.1, 36.2; 442/205–207, 442/239, 243

See application file for complete search history.

(56) References Cited

U.S. PATENT DOCUMENTS

| | | | | |
|---|---|---|---|---|
| 3,214,327 | A * | 10/1965 | Wicker et al. | 162/205 |
| 3,344,609 | A | 10/1967 | Greiser | |

(Continued)

FOREIGN PATENT DOCUMENTS

| | | | |
|---|---|---|---|
| CN | 2431295 | Y | 5/2001 |
| CN | 2675700 | Y | 2/2005 |

(Continued)

OTHER PUBLICATIONS http://www.thefreedictionary.com/ply.*

(Continued)

*Primary Examiner* — Sean Andrish

(74) *Attorney, Agent, or Firm* — Cantor Colburn LLP

(57) ABSTRACT

Described herein is a protected container employed to prevent soil erosion. The protected container is a geotextile container having a debris shield disposed thereon. The debris shield protects the integrity of the geotextile container by providing a strike barrier which has air and water flow capabilities. The debris shield is a composite fabric comprising a woven protective layer having abrasion resistance and a woven three-dimensional layer which provides impact dampening and energy dissipation.

41 Claims, 4 Drawing Sheets

(56) References Cited

U.S. PATENT DOCUMENTS

| | | | | |
|---|---|---|---|---|
| 3,974,313 | A | 8/1976 | James | |
| 4,174,739 | A * | 11/1979 | Rasero et al. | 139/388 |
| 4,624,604 | A * | 11/1986 | Wagner et al. | 405/129.7 |
| 4,657,433 | A | 4/1987 | Holmberg | |
| 4,690,585 | A | 9/1987 | Holmberg | |
| 4,770,561 | A | 9/1988 | Holmberg | |
| 4,889,446 | A | 12/1989 | Holmberg | |
| 5,472,769 | A | 12/1995 | Goerz, Jr. et al. | |
| 5,595,809 | A * | 1/1997 | Dischler | 428/113 |
| 5,651,641 | A | 7/1997 | Stephens et al. | |
| 5,697,736 | A | 12/1997 | Veazey et al. | |
| 5,795,099 | A | 8/1998 | Parker | |
| 5,965,232 | A * | 10/1999 | Vinod | 428/85 |
| 6,216,431 | B1 * | 4/2001 | Andrews | 57/210 |
| 6,627,562 | B1 | 9/2003 | Gehring, Jr. | |
| 6,846,545 | B2 | 1/2005 | Thomas | |
| 6,962,739 | B1 | 11/2005 | Kim et al. | |
| 7,021,869 | B2 | 4/2006 | Sanguinetti | |
| 7,029,205 | B2 | 4/2006 | Daigle | |
| 7,357,598 | B1 * | 4/2008 | Bradley | 405/15 |
| 7,449,105 | B2 | 11/2008 | Hastings | |
| 7,556,854 | B2 | 7/2009 | Farkas et al. | |
| 7,578,317 | B2 * | 8/2009 | Levine et al. | 139/383 A |
| 2003/0022583 | A1 | 1/2003 | Thomas et al. | |
| 2005/0136255 | A1 * | 6/2005 | Gladfelter et al. | 428/375 |
| 2006/0127182 | A1 | 6/2006 | Sanguinetti | |
| 2006/0280563 | A1 | 12/2006 | Glick | |
| 2007/0280789 | A1 | 12/2007 | Mason | |
| 2009/0197021 | A1 | 8/2009 | Jones et al. | |
| 2009/0226653 | A1 * | 9/2009 | Harris et al. | 428/36.1 |
| 2010/0062192 | A1 * | 3/2010 | Morton-Finger | 428/17 |

FOREIGN PATENT DOCUMENTS

| | | | |
|---|---|---|---|
| CN | 1780730 | A | 5/2006 |
| CN | 101302675 | A | 11/2008 |
| CN | 201258490 | Y | 6/2009 |
| CN | 101484641 | A | 7/2009 |
| DE | 19654031 | A1 | 6/1998 |
| EP | 0089032 | A2 | 9/1983 |
| EP | 0450346 | A2 | 10/1991 |
| GB | 853657 | | 11/1960 |
| KR | 2003097575 | A | 12/2003 |
| WO | 2007140950 | A1 | 12/2007 |

OTHER PUBLICATIONS http://dictionary.reference.com/browse/over; date unknown. SA Feb. 6, 2014.*

International Search Report for International Application No. PCT/US2011/025669; International Filing Date: Feb. 22, 2011; Date of Mailing: Oct. 4, 2011; 5 pages.

Written Opinion for International Application No. PCT/US2011/025669; International Filing Date: Feb. 22, 2011; Date of Mailing: Oct. 4, 2011; 7 pages.

ASTM International Designation: D3575-08 Standard Test Method for Flexible Cellular Materials Made From Olefin Polymers, 2008, 9 pages.

ASTM International Designation: D4491-99a (Reapproved 2004) Standard Test Method for Water Permeability of Geotextiles by Permittivity, 2004, 6 pages.

ASTM International Designation: D4491-99a (Reapproved 2009) Standard Test Method for Water Permeability of Geotextiles by Permittivity, 2009, 6 pages.

ASTM International Designation: D4632-08 Standard Test Method for Grab Breaking Load and Elongation of Geotextiles, 2003, 4 pages.

ASTM International Designation: D4632-91 (Reapproved 2003) Standard Test Method for Grab Breaking Load and Elongation of Geotextiles, 2003, 4 pages.

ASTM International Designation: D5199-01 Standard Test Method for Measuring the Nominal Thickness of Geosynthetics, 2001, 4 pages.

ASTM International Designation: D5199-11 Standard Test Method for Measuring the Nominal Thickness of Geosynthetics, 2011, 4 pages.

ASTM International Designation: D5261-10 Standard Test Method for Measuring Mass per Unit Area of Geotextiles, 2010, 3 pages.

ASTM International Designation: D5261-92 (Reapproved 2003) Standard Test Method for Measuring Mass per Unit Area of Geotextiles, 2003, 2 pages.

ASTM International Designation: D737-04 (Reapproved 2008) Standard Test Method for Air Permeability of Textile Fabrics, 2008, 5 pages.

ASTM International Designation: E1886-05 Standard Test Method for Performance of Exterior Windows, Curtain Walls, Doors, and Impact Protective Systems Impacted by Missile(s) and Exposed to Cyclic Pressure Differentials, 2005, 9 pages.

ASTM International Designation: E1996-12 Standard Specification for Performance of Exterior Windows, Curtain Walls, Doors, and Impact Protective Systems Impacted by Windborne Debris in Hurricanes, 2012, 14 pages.

Chinese Office Action dated Jul. 11, 2013 for Application No. 201180009853.6.

Chile Untranslated Office Action dated Aug. 17, 2014, 7 pages.

Chinese Office Action for CN Application No. 201180009853.6; dated Jul. 11, 2013; 10 pages.

Chinese Office Action, Untranslated dated Mar. 7, 2014 for CN20118009853.6 (PCT/US2011/02569); 9 pages.

New Zealand Examination Report dated Apr. 10, 2014 for NZ Application No. 601708; 2 pages.

Philippine Office Action dated Dec. 9, 2013 for PH Application No. 1/2012/501663; 1 page.

* cited by examiner 10
12
14
20
21
22

23
24
22
24
22

DEBRIS SHIELD FOR GEOCONTAINERS, METHOD OF MAKING, AND METHOD OF USE THEREOF

CROSS-REFERENCE TO RELATED APPLICATION

This application claims benefit of U.S. Provisional Patent Application Ser. No. 61/306,215 filed Feb. 19, 2010, which is incorporated herein in its entirety by reference.

TECHNICAL FIELD OF THE INVENTION

The present invention relates generally to geocontainers employed to abate soil erosion. More specifically, the present invention is related to woven geotextile fabrics which absorb an impact force of a moving object and geocontainers employing such fabrics.

BACKGROUND OF THE INVENTION

Geotextile containers, also known as geocontainers, e.g., TenCate Geosynthetics North America's Geotube®, are employed to protect shorelines, rebuild beaches, and reclaim land from bodies of water. Typically, geocontainers are filled with sand or other soil and are placed above or within the soil of the land being protected. However, such containers are subject to damage from debris that is carried by these bodies of water.

Often damage to the geocontainers occurs from inclement weather conditions, such as storms which generate heavy wind and/or seas. Damage also occurs from vandalism, boat propellers, and a number of other situations. When the integrity of the geocontainer is compromised or damaged, the geocontainer loses its ability to provide protection from erosion and other property damage. Once an installed geotextile container is punctured, the sand reinforcing the geotextile container flows out, thereby compromising its performance. Moreover, as waves hit the geotextile container, more and more sand escapes, and the geotextile container's height decreases. As a result, soil erosion potential to the shoreline increases. Accordingly, there is a need to protect geocontainers from damage by debris, vandalism, propellers, or any situation in which the integrity of the geocontainer could be compromised. It is to that end that the instant invention is directed.

SUMMARY OF THE INVENTION

In accordance with the present invention, a debris shield is described herein which is employed to protect a geotextile container from damage often suffered as a result of high winds, rapid water, projectiles, vandalism and the like. The debris shield has at least two layers. One layer is an abrasion resistant woven fabric, and the other layer is a single-weave three-dimensional fabric having no more than about a 10% compression at a load of at least 20 pounds/inch$^2$.

In another aspect the three-dimensional fabric has no more than about a 10% compression at a load of at least 32 pounds/inch$^2$ and an air flow of at least 700 cubic feet/minute.

Yet, in another aspect the three-dimensional fabric has no more than about a 10% compression at a load of at least 32 pounds/inch$^2$, a water flow between about 20 gallons per minute/foot$^2$ and about 350 gallons per minute/foot$^2$, and an air flow of at least 750 cubic feet/minute.

Still, in another aspect the debris shield has at least two layers. One layer is an abrasion resistant woven fabric and the other layer is a three-dimensional, plain 4-layer tubular weave having an air flow of at least 750 cubic feet/minute. The debris shield has an impact resistance of at least 105 feet/second as measured in accordance with American Society for Testing Materials ASTM International (ASTM) Standards E1886-05 and E1996-12.

Additionally, a protected geocontainer is described herein. The protected geocontainer has a geotextile container for receiving and retaining soil and/or water and the debris shield disclosed herein disposed over at least a portion of the geotextile container.

The protected container is made by positioning a debris shield as disclosed herein over at least a portion of a geotextile container and anchoring the debris shield so that it is secured to the geotextile container. In another aspect, the protected container is made by attaching the debris shield to the geotextile container by binder yarn.

BRIEF DESCRIPTION OF THE DRAWINGS

The disclosure below makes reference to the annexed drawings wherein.

DETAILED DESCRIPTION

Figure 1:
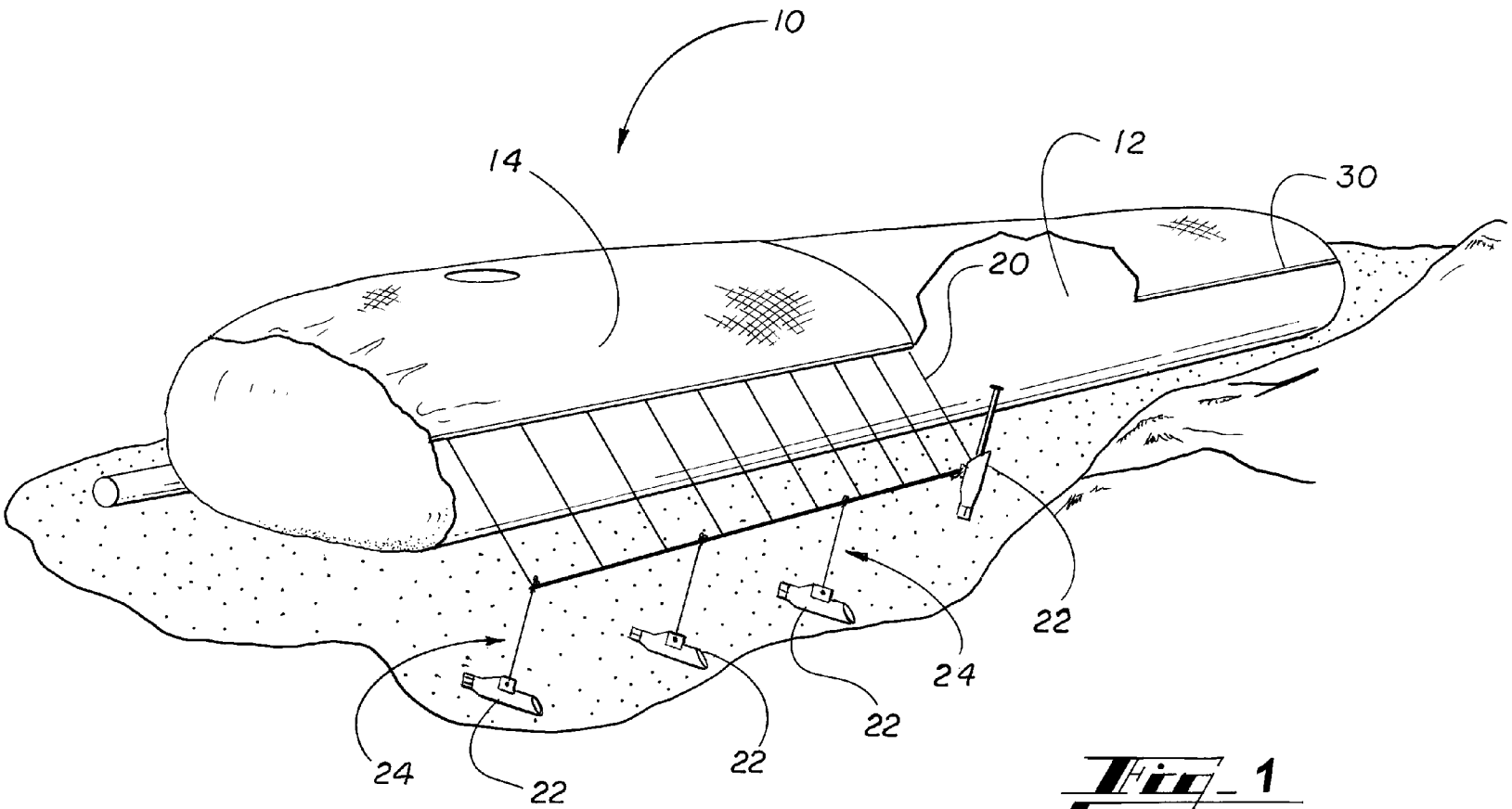
FIG. 1 is a perspective view of a geocontainer and a debris shield, in partial perspective view, disposed thereon in accordance with the present invention.

Referring to FIG. 1, a protected container 10 made in accordance with the present invention is illustrated. The protected container 10 has a geotextile container 12, also referred to as a geocontainer, and an energy dissipating debris shield 14 attached thereto. The geotextile container 12 can be any such container known in the art. Further, the geotextile container 12 typically comprises a woven fabric formed into a closed container generally of cylindrical shape. The woven fabric comprises the geotextile container 12 can comprise any yarn mentioned herein. The debris shield 14 protects the integrity of the geotextile container 12 by providing a strike barrier from objects or individuals. As a result, the debris shield 14 prevents the geotextile container 12 from being torn, cut, ripped, and the like, and thereby maintains the container's integrity and extends the service life of the geotextile container 12. The debris shield 14 can be attached to an existing geotextile container 12 which is already installed in the field or to a geotextile container 12 before or after it is filled. In addition, the debris shield 14 provides permeability for air, water, and soil, such as sand, plus the ability to dissipate impact energy to prevent damage to a geotextile container 12.

Figure 5:
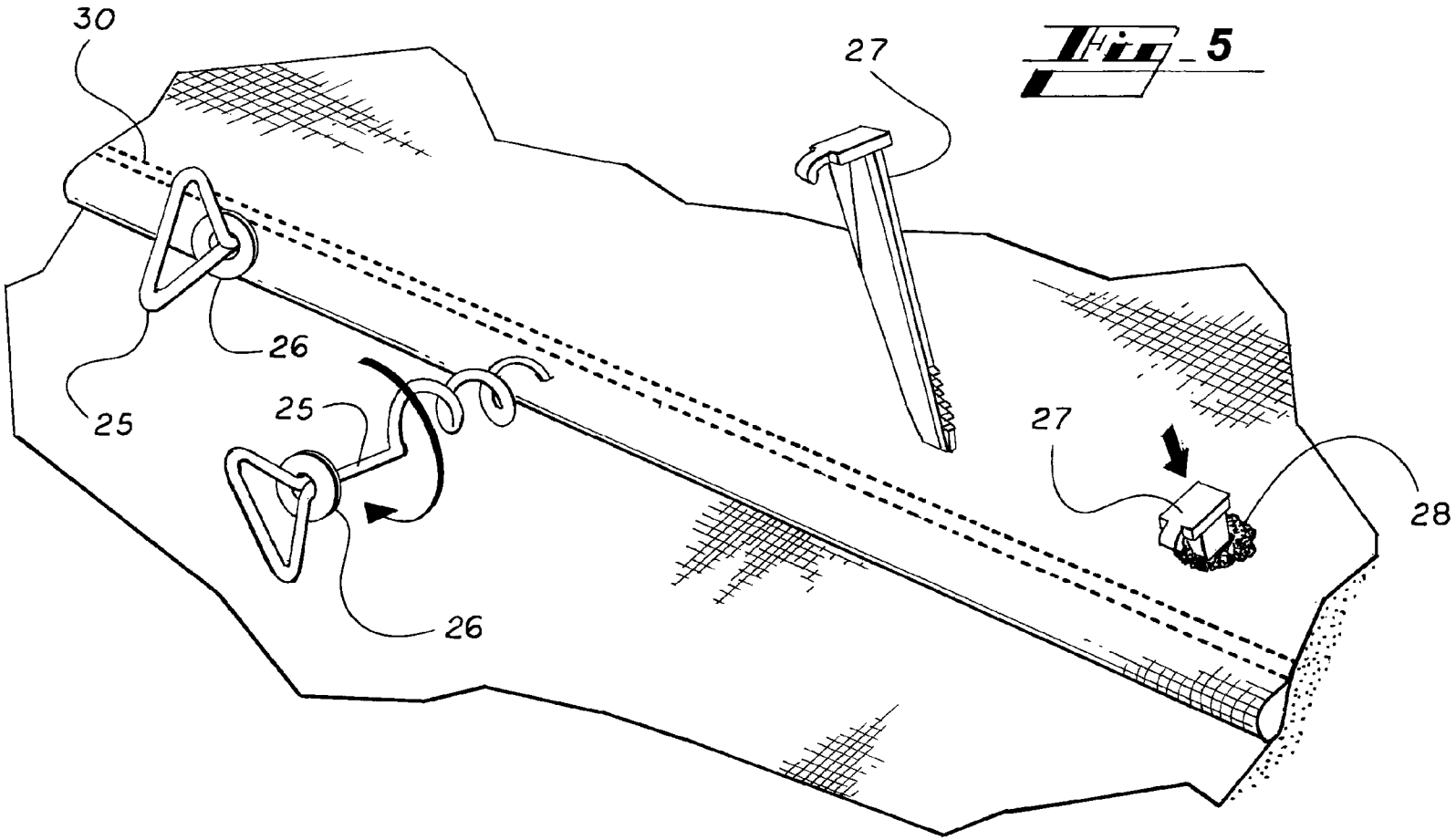
FIG. 5 is a partial view of the debris shield mounted to the geocontainer.

Debris shield 14 is a composite fabric comprising two independently woven layers. One layer is a protective layer 18 comprising yarns which form an abrasion resistant fabric. For example, protective layer 18 can comprise polypropylene yarns. In addition, such polypropylene yarns can have high ultraviolet light or radiation resistance. The other layer is a three-dimensional layer 16 which provides impact dampening and energy dissipation. The three-dimensional layer 16 comprises a three-dimensional, plain 4-layer tubular weave with multiple yarns in both diameter warp and fill and varying degrees of shrinker force. In one aspect the three-dimensional layer 16 comprises a combination of polypropylene and polyethylene yarns. As illustrated in FIGS. 1 and 5, the debris shield 14 comprises the protective layer 18 and three-dimensional layer 16 bound together by binder yarns 30 comprising any of the yarns mentioned herein. Binder yarn 30 can comprise any yarn mentioned herein.

In one aspect the debris shield 14 made in accordance with this disclosure has the protective layer 18 of an abrasion resistant woven fabric and the three-dimensional layer formed of a plain 4-layer tubular weave having air flow, e.g., at least 750 cubic feet/minute, and/or water flow characteristics as described below. Such debris shield 14 has an impact resistance of at least 105 feet/second as measured in accordance with ASTM International Standards E1886-05 and E1996-12. Further, such debris shield 14 has an impact resistance of at least 110 feet/second. Still further, debris shield 14 has an impact resistance of at least 115 feet/second. Yet further, debris shield 14 has an impact resistance of at least 120 feet/second. Even further, debris shield 14 has an impact resistance of at least 125 feet/second.

As discussed above, once an installed geotextile container is punctured, the sand reinforcing the container flows out and compromises the container's performance. Moreover, as waves hit the tube, more and more sand escapes. As the contents of the container escape, the container height decreases, thereby increasing erosion potential to the shoreline. The present invention protects the geotextile container 12 from impact of debris carried by water or from severe weather. When debris strikes the debris shield 14, the shield dissipates the energy from the impact. Yet, the debris shield 14 is permeable to allow air, water, and sand to pass through. Further, the debris shield 14 provides additional UV protection as well as abrasion resistance since the geotextile container 12 is covered by the addition of this shroud. Moreover, the method of attachment of the debris shield 14 provides that the shield remains in place on the geotextile container 12 when the container is stressed by impact from debris or weather. To that end, the debris shield 14 can be utilized in other protective applications, for example, to cover windows, doors, any structural feature of a building, automobiles, or any article which is exposed to high winds and projectiles that one may desire to protect. These examples are only illustrative and should not be considered as limiting.

Although heavy weight fabrics, such as conveyor belting, or coated fabrics can be used to initially protect the geotextile container, such systems are not permeable to air, water, or sand. Water can flow behind such impermeable fabrics and separate them from the container via the wave forces at their retreat from land back to the water source. The present invention is designed to dissipate energy from impact and prevent separation of the protective shroud, i.e, the debris shield, from the tube, whereas the above-described alternative only acts as a protective cover.

The protected container 10 can be employed either above or below ground. The phrase "above ground" means that at least a portion of the container is exposed to the atmosphere. There are many more technical properties which can extended service life and durability in an above ground application; for example, ultraviolet light or radiation ("UV") resistance, impact resistance, and permeability.

Figure 2:
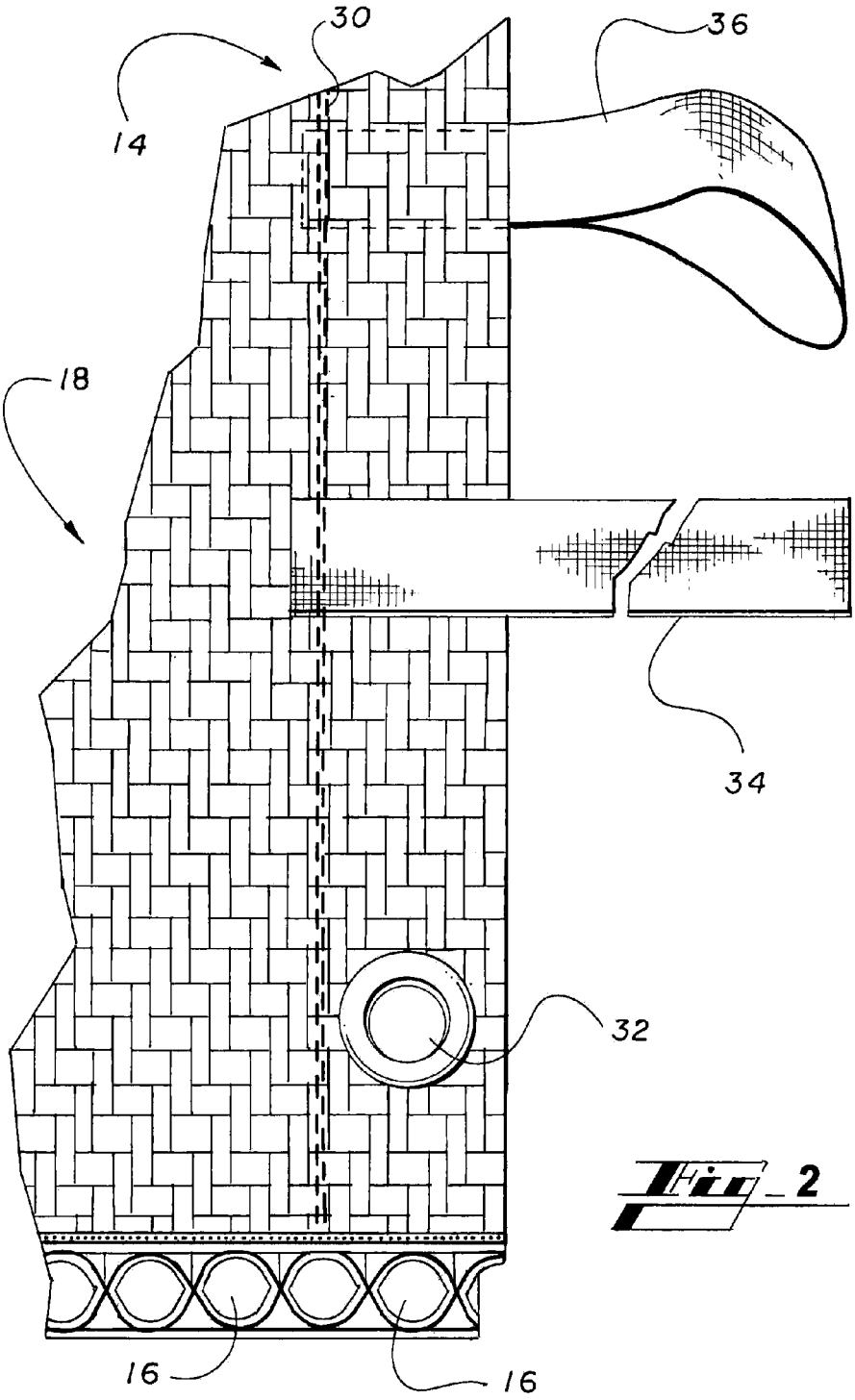
FIG. 2 is a perspective view of the debris shield in accordance with the present invention illustrating the layers thereof and attachment options.

The three-dimensional layer encompasses a three-dimensional woven structure designed to protect the geocontainer casing from being cut or torn and to provide a means to dissipate energy due to its compressive resistance. FIG. 2 is representative of the woven structure. The three-dimensional layer 16 reduces wave energy due to its internal structure provided by the woven three-dimensional fabric, for example, woven cylinders and a tortuous path to penetrate the material. The protective layer 18 provides abrasion resistance, cut resistance, and supports the energy dissipation aspect of the three-dimensional layer 16. Additionally, the debris shield 14 can be used to retrofit existing geocontainers.

As illustrated, the woven three-dimensional layer 16 is a single weave fabric comprising shrink and non-shrink yarns. A shrink yarn is a yarn or monofilament which has a predetermined differential heat shrinkage characteristic that is greater than a yarn or monofilament employed as a non-shrink yarn. Methods of making the illustrated three-dimensional layer 16 are described in U.S. Patent Application Publication No. US 2009/0197021 to Jones et al., which is incorporated herein by reference in its entirety, and United Kingdom Patent No. 853,697 (also referenced as GB 853,697) published Nov. 9, 1960 and issued to United States Rubber Company. The three-dimensional layer 16 comprises:

- first and second fabric layers comprising non-shrink yarns in the warp direction;
- third and fourth fabric layers comprising shrink yarns in the warp direction; wherein
- the first and second fabric layers are sandwiched between the third and fourth fabric layers, wherein
- the first and second fabric layers zigzag between the third and fourth layers and are alternatingly connected to the third and fourth layer, and wherein
- the first and second zigzagging fabric layers are shifted relatively to each other over half a phase and are intertwined with each other.

For example, the three-dimensional layer 16 can be made from at least two types of yarn with different shrink characteristics. One type of yarn can have a relatively high shrink characteristic, such as polyethylene yarns while the other type of yarn can have a relatively low or no shrink characteristic, such as a polypropylene or polyester yarn. In addition, the shrink and non-shrink yarns can be of the same type of polymer, but of differing class with respect to shrinkage. For example, both the shrink and non-shrink yarns can be polyethylene, but one class of the polyethylene has a different shrink characteristic than the other class of polyethylene. The yarns can be woven or otherwise fixed together to from an essentially flat structure. Thereafter, the flat woven structure is heated to shrink the shrink yarn and cause some or all of the yarns to increase in density and form a tubular-shaped fabric.

By heating the shrink yarns, the length of the first and second fabric layer decreases. The length of the third and fourth layer will remain constant, as this layer is made of non-shrink yarns. As a result the extra length has to be compensated. As the third and fourth layer are already zigzagging, the non-shrink yarns curve and as the first and second zigzagging layers are shifted over half a phase, tubular structures are formed. These tubular structures are inherently strong as a result of the shape and can provide the desired shock absorbency. Also the tubular structure provides channels within the fabric, thereby providing drainage.

Typically, yarns employed in the three-dimensional layer 16 have a size between about 500 denier and about 5,000 denier. Non-shrink yarns employed in the three-dimensional layer 16 can have a size in a range between about 8 mils to about 30 mils. Shrink yarns typically have a size in a range between about 150 denier and about 1,800 denier. For example, a 20 mil, round polypropylene yarn can be employed as non-shrink yarn, and 315 denier, round low density polyethylene monofilament can be employed as the shrink yarn. In one aspect polypropylene yarn has a size between about 8 mils and about 30 mils. Low density polyethylene yarn has a size between about 200 denier and about 1,800 denier. The sizes of the yarns employed in the three-dimensional layer can comprise sizes different from those mentioned above. Thus, the sized mentioned should not be considered as limiting.

The three-dimensional layer 16 typically comprises a thickness of about 500 mils. In another aspect the three-dimensional layer 16 has a thickness between about 200 mils and about 1,000 mils. Still, in another aspect the thickness of the three-dimensional layer 16 is between about 150 mils and about 1,200 mils. Yet, in another aspect the thickness of the three-dimensional layer 16 is between about 250 and about 1,000 mils. Further, in another aspect the thickness of the three-dimensional layer 16 is between about 400 mils and about 750 mils. Yet still, in another aspect the thickness of the three-dimensional layer 16 is about 150 mils, about 200 mils, about 250 mils, about 300 mils, about 350 mils, about 400 mils, about 500 mils, about 550 mils, about 600 mils, about 650 mils, about 700 mils, about 750 mils, about 800 mils, about 850 mils, about 900 mils, about 950 mils, about 1,000 mils, about 1,050 mils, about 1,100 mils, about 1,150 mils, about 1,200 mils, or any range therebetween. Thickness is determined in accordance with ASTM International (ASTM) Standard D5199-01 (2006) entitled "Standard Test Method for Measuring the Nominal Thickness of Geo synthetics".

Typically, the density or weight of the three-dimensional layer 16 is about 18 ounces/yard$^2$ ("osy"). In another aspect the weight of the three-dimensional layer 16 is between about 15 osy and about 22 osy. Still in another aspect the weight of the three-dimensional layer 16 is about 16 osy±5 osy. Yet, in another aspect the weight of the three-dimensional layer 16 is about 15 osy, about 15.5 osy, about 16 osy, about 16.5 osy, about 17 osy, about 17.5 osy, about 18 osy, about 18.5 osy, about 19 osy, about 19.5 osy, about 20 osy, about 20.5 osy, about 21 osy, about 21.5 osy, about 22 osy, about 22.5 osy, about 23 osy, about 23.5 osy, about 24 osy, about 24.5 osy, about 25 osy, or any range therebetween. Weight is determined in accordance with ASTM Standard D5261-10 entitled "Standard Test Method for Measuring Mass per Unit Area of Geotextiles".

As mentioned above, the three-dimensional layer 16 comprising the debris shield 14 provides shock absorbency. Shock absorbency is expressed herein as a function of the compressibility of the fabric when subjected to a given load. Compressibility is determined in accordance with ASTM Standard D3575-08 entitled "Standard Test Methods for Flexible Cellular Materials Made from Olefin Polymers". The three-dimensional layer 16 employed in the debris shield 14 has 10% compression at a load of about 32 pounds/inch ("psi"). In another aspect the three-dimensional layer 16 has 25% compression at a load of about 38 psi. Yet, in another aspect the three-dimensional layer 16 has 50% compression at a load of about 45 psi. Still, in another aspect the three-dimensional layer 16 has 10% compression at a load of about 10 psi. Yet still, in another aspect the three-dimensional layer 16 has 10% compression at a load of about 20 psi. Still further, in another aspect the three-dimensional layer 16 has 10% compression at a load of about 20 psi, about 25 psi, about 26 psi, about 27 psi, about 28 psi, about 29 psi, about 30 psi, about 31 psi, about 32 psi, about 33 psi, about 34 psi, about 35 psi, or any range therebetween. Still yet further, in another aspect the three-dimensional layer 16 has 50% compression at a load of about 50 psi, about 60 psi, about 70 psi, about 80 psi, about 90 psi, about 100 psi, about 110 psi, about 120 psi, about 130 psi, about 140 psi, about 150 psi, or any range therebetween.

Typically, the three-dimensional layer 16 has a grab tensile of about 800 pounds warp and about 800 pounds fill as determined in accordance with ASTM Standard D4632-08 entitled "Standard Test Method for Grab Breaking Load and Elongation of Geotextiles". In another aspect the grab tensile warp is about 700 pounds, about 750 pounds, about 800 pounds, about 850 pounds, or any range therebetween. Still, in another aspect the grab tensile fill is about 700 pounds, about 750 pounds, about 800 pounds, about 850 pounds, or any range therebetween.

As mentioned above, the three-dimensional layer 16 has excellent air flow characteristics. Air flow is determined by ASTM Standard D737-04 (2008)e1 entitled "Standard Test Method for Air Permeability of Textile Fabrics". Typically, the three-dimensional layer 16 has an air flow of about 1,000 cubic feet/minute (cfm). In another aspect, the three-dimensional layer 16 has an air flow of about 700 cfm, about 750 cfm, about 800 cfm, about 850 cfm, about 900 cfm, about 950 cfm, about 1,000 cfm, about 1,050 cfm, or any range therebetween.

Also mentioned above, the three-dimensional layer 16 has excellent water flow characteristics. Water flow is determined by ASTM Standard D4491-99a(2009) entitled "Standard Test Methods for Water Permeability of Geotextiles by Permittivity". Typically, the three-dimensional layer 16 has a water flow of about 200 gallons per minute/foot ("gpm/ft$^2$"). In another aspect, the three-dimensional layer 16 has a water flow between about 20 gpm/ft$^2$ and about 350 gpm/ft$^2$. Yet, in another aspect, the three-dimensional layer 16 has a water flow of about 30 gpm/ft$^2$, flow of about 40 gpm/ft$^2$, flow of about 50 gpm/ft$^2$, flow of about 60 gpm/ft$^2$, flow of about 70 gpm/ft$^2$, flow of about 80 gpm/ft$^2$, flow of about 90 gpm/ft$^2$, flow of about 100 gpm/ft$^2$, flow of about 120 gpm/ft$^2$, flow of about 130 gpm/ft$^2$, flow of about 140 gpm/ft$^2$, flow of about 150 gpm/ft$^2$, flow of about 160 gpm/ft$^2$, flow of about 170 gpm/ft$^2$, flow of about 180 gpm/ft$^2$, flow of about 190 gpm/ft$^2$, flow of about 200 gpm/ft$^2$, flow of about 210 gpm/ft$^2$, flow of about 220 gpm/ft$^2$, flow of about 230 gpm/ft$^2$, flow of about 240 gpm/ft$^2$, flow of about 250 gpm/ft$^2$, flow of about 260 gpm/ft$^2$, flow of about 270 gpm/ft$^2$, flow of about 280 gpm/ft$^2$, flow of about 290 gpm/ft$^2$, flow of about 300 gpm/ft$^2$, flow of about 310 gpm/ft$^2$, flow of about 320 gpm/ft$^2$, flow of about 330 gpm/ft$^2$, flow of about 340 gpm/ft$^2$, flow of about 350 gpm/ft$^2$, or any range therebetween.

Protective layer 18 comprises a durable, high abrasion resistant woven fabric. Typically, the protective layer 18 comprises a high abrasion resistant yarn. In one aspect the yarn comprising the protective layer 18 is treated with an UV stabilizer to provide UV resistance. Such stabilizers are known in the art and commercially available. An example of a durable, high abrasion resistant yarn is polypropylene.

Typically, the protective layer 18 has a thickness between about 50 mils and about 250 mils. In another aspect the thickness of the protective layer 18 is at least 80 mils. Yet, in yet another aspect of the present invention, the protective layer 18 has a thickness of about 150 mils. Still, in another aspect the protective layer 18 has a thickness of about 50 mils, about 60 mils, about 70 mils, about 80 mils, about 90 mils, about 100 mils, about 110 mils, about 120 mils, about 130 mils, about 140 mils, about 150 mils, or any range therebetween. Thickness is determined in accordance with ASTM International (ASTM) Standard D5199-01 (2006).

Warp and fill yarns comprising the protective layer 18 can be monofilaments, tape yarns, spun yarns, and/or fibrillated yarns. The range of the size of the yarns employed in either direction are between about 1,000 denier and about 15,000 denier. In another aspect the range of the size of the yarns are between about 500 and about 5000 denier. Yet, in another aspect, the warp yarns are between about 10,000 and about 15,000 denier, and the fill yarns are between about 3,500 denier and about 5000 denier. The yarns can comprise any shape, such as round, oval, rectangular, square, etc.

Also, the protective layer 18 has a density of about 33 osy+/−8 osy. Weight is determined in accordance with ASTM Standard D5261-10.

As known in the art, a woven fabric has two principle directions, one being the warp direction and the other being the weft direction. The weft direction is also referred to as the fill direction. The warp direction is the length wise, or machine direction of the fabric. The fill or weft direction is the direction across the fabric, from edge to edge, or the direction traversing the width of the weaving machine. Thus, the warp and fill directions are generally perpendicular to each other. The set of yarns, threads, or monofilaments running in each direction are referred to as the warp yarns and the fill yarns, respectively.

A woven fabric can be produced with varying densities. This is usually specified in terms of number of the ends per inch in each direction, warp and fill. The higher this value is, the more ends there are per inch and, thus, the fabric density is greater or higher.

The weave pattern of fabric construction is the pattern in which the warp yarns are interlaced with the fill yarns. A woven fabric is characterized by an interlacing of these yarns. There are many variations of weave patterns commonly employed in the textile industry, and those of ordinary skill in the art are familiar with most of the basic patterns. While it is beyond the scope of the present application to include a disclosure of these multitude of weave patterns, the basic plain, twill, satin, weave patterns can be employed with the protective layer 18. However, such patterns are only illustrative, and the invention is not limited to such patterns. It should be understood that those of ordinary skill in the art will readily be able to determine how a given weave pattern could be employed in practicing the present invention in light of the parameters herein disclosed.

Plain weave is characterized by a repeating pattern where each warp yarn is woven over one fill yarn and then woven under the next fill yarn. As mentioned above, spacing between warp and fill yarns of the protective layer 18 is maintained to provide permeability for water, soil, and air as mentioned above.

A twill weave, relative to the plain weave, has fewer interlacings in a given area. The twill is a basic type of weave, and there are a multitude of different twill weaves. A twill weave is named by the number of fill yarns which a single warp yarn goes over and then under. For example, in a 2/2 twill weave, a single warp end weaves over two fill yarns and then under two fill yarns. In a 3/1 twill weave, a single warp end weaves over three fill yarns and then under one fill yarn. For fabrics being constructed from the same type and size of yarn, with the same thread or monofilament densities, a twill weave has fewer interlacings per area than a corresponding plain weave fabric. In one aspect of the present invention, the protective layer 18 is woven in a 4/4 twill weave with three picks per shed.

A satin weave, relative to the twill and plain weaves, has fewer interlacings in a given area. It is another basic type of weave from which a wide array of variations can be produced. A satin weave is named by the number of ends on which the weave pattern repeats. For example, a five harness satin weave repeats on five ends and a single warp yarn floats over four fill yarns and goes under one fill yarn. An eight harness satin weave repeats on eight ends and a single warp yarn floats over seven fill yarns and passes under one fill yarn. For fabrics being constructed from the same type of yarns with the same yarn densities, a satin weave has fewer interlacings than either a corresponding plain or twill weave fabric.

The process for making geotextile fabrics is well known in the art. Thus, the weaving process employed can be performed on any conventional textile handling equipment suitable for producing the fabric of the present invention. Further, any of the aforementioned patterns weaves may be employed as long as the protective layer 18 made therefrom is sufficient to provide the aforementioned cut and tear resistance while maintaining permeability for water, soil, and air. In one aspect the protective layer 18 is woven in a 2/2 twill or plain weave pattern.

The fibers or mono filaments comprising the aforementioned yarns are typically thermoplastic polymers. Additionally, yarns comprising natural fibers can be employed in the present invention. Polymers which may be used to produce the protective layer 18 and the three-dimensional layer 16 of the debris shield 14 include, but are not limited to, polyamides (for example, any of the nylons), polyimides, polyesters (for example, high tenacity polyesters, polyethylene terephthalate, such as mono polyethylene terephthalate, polybutylene terephthalate, and aromatic polyesters, for example, Vectran®), polyacrylonitriles, polyphenylene oxides, fluoropolymers, acrylics, polyolefins (for example, low density polyethylene (LDPE), linear low density polyethylene (LLDPE), high density polyethylene (HDPE), co-polymers of polyethylene, polypropylene, and higher polyolefins), polyphenylene sulfide, polyetherimide, polyetheretherketone, polylactic acid (also known as polylactide), aramids (for example, para-aramids, which include Kevlar®, Technora®, Twaron®, and meta-paramids, for example, Nomex®, and Teijinconex®), aromatic ether ketones, vinalon, and the like, and blends of such polymers which can be formed into microfilaments. The yarns can comprise any shape, such as round, oval, rectangular, square, etc. Further, the yarns can comprise other agents, materials, dyes, plasticizers, etc. which are employed in the textile industry. In one aspect the yarns comprise an ultraviolet radiation resistant additive. It will be understood that any materials capable of producing fibers or microfilaments suitable for use in the instant fabric of the present invention fall within the scope of the present invention and can be determined without departing from the spirit thereof.

Furthermore, the respective yarns employed in the protective layer 18 and the three-dimensional layer 16 comprise at least one additive commonly used in conjunction with the material of the fiber. Such additives include, but are not limited to, plasticizers, processing aids, scavengers, heat stabilizers, antistatic agents, slip agents, dyes, pigments, antioxidants, ultraviolet light (radiation) stabilizers, metal deactivators, antistatic agents, flame retardants, lubricants, biostabilizers, and biocides.

The antioxidants, light stabilizers, and metal deactivators employed, if appropriate or desired, can have a high migration fastness and temperature resistance. Suitable antioxidants, light stabilizers, and metal deactivators include, but are not limited to, 4,4-diarylbutadienes, cinnamic esters, benzotriazoles, hydroxybenzophenones, diphenylcyanoacrylates, oxamides (oxalamides), 2-phenyl-1,3,5-triazines; antioxidants, nickel compounds, sterically hindered amines, metal deactivators, phosphites and phosphonites, hydroxylamines, nitrones, amine oxides, benzofuranones and indolinones, thiosynergists, peroxide scavengers, and basic costabilizers.

Examples of suitable antistatic agents include, but are not limited to, amine derivatives such as N,N-bis(hydroxyalkyl) alkylamines or -alkyleneamines, polyethylene glycol esters and ethers, ethoxylated carboxylic esters and carboxamides, and glycerol monostearates and distearates, and also mixtures thereof.

The additives are used in typical amounts as provided in the respective product literature. For example, the respective additives, when present, are in an amount from about 0.0001% to 10% by weight based upon the total weight of the fiber. In another aspect, the respective additives are present in an amount from about 0.01% to about 1% by weight based on the total weight of the respective fiber.

Referring to FIGS. 1-5, the debris shield 14 is installed over the geotextile container 12. As illustrated support straps 20 extend from the debris shield 14. The straps 20 can comprise wire, cable, polymers, natural fibers, or any material of any weave or shape that can be attached to the debris shield 14. Anchors 22, which resist removal from the ground via wave or wind forces, are positioned in the soil.

Figure 3:
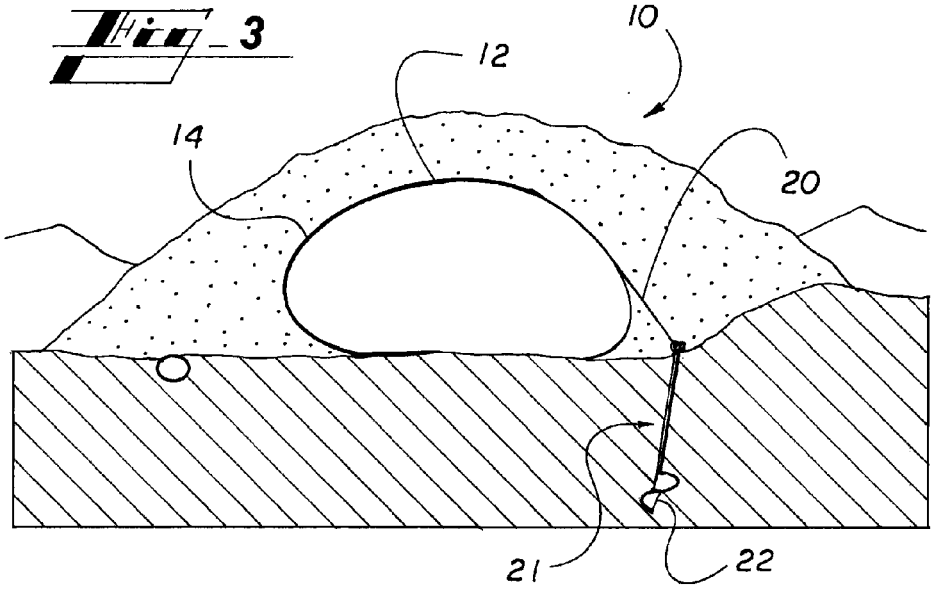
FIG. 3 is an elevation view of the geocontainer and debris shield in accordance with the present invention.
Figure 4:
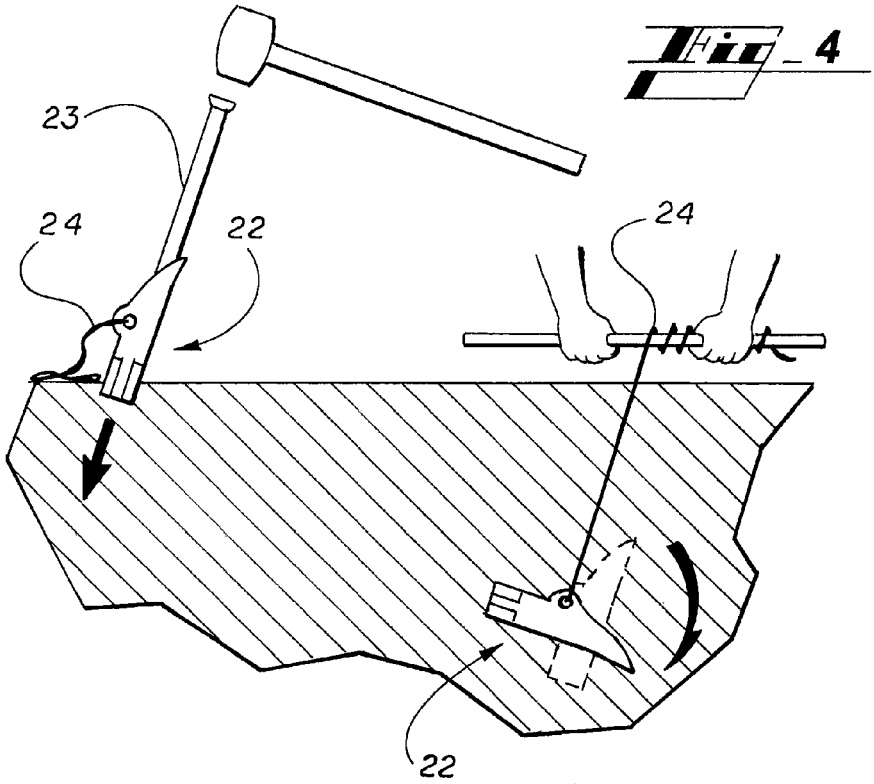
FIG. 4 is an illustration of an optional anchor installation employed to secure the debris shield and geocontainer at a desired location.

An example of an anchor 22 employed with the present invention is a duckbill anchor, which is illustrated in FIGS. 1, 3 and 5. As indicated in FIG. 4, the anchor 22 is driven into the ground by striking a spike 23 temporarily disposed therein until the anchor 22 reaches a desired depth. Thereafter, spike 23 is withdrawn, and a pivot cable 24 is pulled by an operator to cause the anchor 22 to rotate and substantially lodge and stabilize the anchor 22 within the ground. Once the desired number of anchors 22 are installed, that is, a sufficient number to secure the debris shield 14 to the container 12, the operator connects the debris shield 14 to the anchors 22 by respective support straps 20.

Referring to FIG. 5, in addition or alternatively to anchor 22, a screw anchor 25 and/or a stake 27 can be employed to secure the debris shield 14 to the container 12. In one aspect the screw anchor 25 is installed by the operator by a conducting a twisting motion of the screw anchor 25 to penetrate the soil to a desired depth. Once the desired number of screw anchors 25 are installed, that is, a sufficient number to secure the debris shield 14 to the container 12, the operator connects the debris shield 14 to the screw anchors 25 by respective support straps 20. In another aspect the screw anchor 25 secures the debris shield 14 to the container 12 without straps. This is accomplished by inserting the screw anchor 25 into the container 12 through the debris shield 14. A washer 26 is provided on the screw anchor 25 to apply pressure to the debris shield 14 to prevent leakage of the contents of the container 12 and movement and/or tearing of the debris shield 14 upon installation.

Stake 27 is conventionally driven into the ground. Once the desired number of stakes 27 are installed, that is, a sufficient number to secure the debris shield 14 to the container 12, the operator connects the debris shield 14 to the stakes 27 by respective support straps 20. In another aspect the stakes 27 are employed to secure the debris shield 14 to the container 12 without straps. This is accomplished by initially puncturing the debris shield 14 and driving the stake into the container 12. As illustrated in FIG. 5, a layer of sealant 28, such as an asphalt-based sealant, is placed on the debris shield 14 in the area immediately adjacent the stake 27. The sealant layer 28 is provided to seal the puncture area around the stake 27 to prevent leakage of the contents of the container there through. Typically, any sealant known in the art which is compatible with the polymers comprising the protective layer 18 can be employed. One example of an asphalt-based sealant which can be employed in the present invention is DAP® Roof Watertight Asphalt Filler & Sealant manufactured by DAP Products Inc.

The straps 20 are respectively secured to the anchors 22, either directly or by an anchor line 21 which is secured to the anchor 22 and extends therefrom. Referring again to FIG. 5, the debris shield 14 can have securing aides to assist in connecting the straps 20 to the anchoring devices mentioned above. In one aspect a grommet 32 is provided through which the strap 20 can be secured. In another aspect a belt 34 is attached directly to the debris shield and can be utilized as a replacement for or in addition to the straps 20. Still in another aspect, a loop 36 is attached directly to the debris shield 18 through which the strap 20 can be secured.

Also, the debris shield 14 can be fitted with anchor tubes (not shown) which extend the length of the debris shield 14. Anchor tubes can have a circumference of 2-4 feet, for example, and are filled with sand or soil slurry. The anchor tubes can be directed attached to the debris shield 14 or can lay over the top of a portion of the debris shield which extends outwardly on the ground away from the geotextile container 12. The weight of the filled anchor tube holds or secures the debris shield in place over the geotextile container.

In new construction the debris shield 14 can be secured to the geotextile container 12 by binder yarn 30. Binder yarn 30 is woven though the debris shield 14 and the geotextile container 12 by conventional sewing, thereby securing the debris shield 14 to the container 12 prior to container filling at a location in the field. Thereafter, the protected container is conventionally filed with water and/or soil.

EXAMPLE

Impact tests were conducted in accordance with ASTM International Standards E1886-05 and E1196-12. The results are reported in Table 1 below. 11 test units consisting of 21 inch×21 inch square bags, having the appearance of a pillow, respectively containing approximately 100 pounds of sand (volume of sand was 1 cubic foot) were tested. Units 5-7 and 10 employed a debris shield made in accordance with the above description.

All three-dimensional layers of the debris shield were a plain 4-layer tubular weave having a thickness of about 625 mils. In the warp direction, non-shrink yarn was 20 mil round polypropylene and the shrink yarn was a 315 denier low density polyethylene round monofilament. Fill yarn was 565 denier round monofilament polypropylene.

All bags employed in the impact test were formed of a woven fabric of 11,000 denier polypropylene fibrillated warp yarns twisted at 1.5 tpi and 4600 denier polypropylene fibrillated fill yarns. The weave was a 2/2 twill, 3 pick per shed having an 11×28 construction and weight of about 25 osy. Each bag had a 2 inch polyvinylchloride port centered on one side to permit filling with sand. During the test, the port was secured from movement and the side thereon was directed away from the missile launcher to avoid affecting the outcome of the impact test. Units 1, 2, and 4 were only the unprotected bags.

Units 3, 8, and 9 were spray coated with a layer of polyurea having a thickness between 30 and 40 mils.

Unit 5 employed a debris shield. The protective layer was fabricated having a 34×18 construction in a 2/2 twill weave with 2 pick insertion covering the impact side of the bag. The warp yarn was a 1360 denier oval-shaped monofilament of polypropylene and the fill yarn was a 4600 denier fibrillated tape polypropylene. The fabric weight was about 17.5 osy. The three-dimensional layer is described above Unit 6 employed a debris shield. The protective layer was fabricated having a 45×23 construction in a 2/2 twill weave with 3 pick insertion. The warp yarn was a 1360 denier polypropylene, oval-shaped monofilament. The fill yarn was a 4600 denier fibrillated polypropylene yarn. The fabric weight was about 22.5 osy.

Units 7 and 10 employed a debris shield. The protective layer was the same woven fabric as the bag.

Unit 11 employed a woven fabric shroud which covered the bag. The shroud was the same woven fabric as the bag.

The units were strapped to impact stands and impacted at the geometric center with a missile 92 inches in length, 4 inches wide, 2 inches in height, and weighing about 9.25 pounds. The results of the test are provided in Table 1 below. From the result, it can be concluded that the units protected by the debris shield provided enhanced impact resistance over the other units. In addition, the test results show that the debris shield can receive multiple strikes above 115 feet/second at the same location which shows durability.

TABLE 1

| Test Unit # | Impact # | Missile Weight (lbs.) | Missile Length (lbs.) | Missile Velocity (ft/sec) | Missile Velocity (mph) | Impact Energy (mph) | (Impact Energy (J) | Pass/ FAIL | Failure Type |
|---|---|---|---|---|---|---|---|---|---|
| 1 | 1 | 9.2 | 94 | 49.02 | 33.42 | 343 | 466 | Pass | 3" × 1" tear |
| | 2 | | | 46.82 | 31.93 | 313 | 426 | Pass | in the bag |
| | 3 | | | 45.25 | 30.85 | 293 | 398 | Pass | |
| | 4 | | | 81.63 | 55.66 | 952 | 1,295 | Pass | |
| | 5 | | | 81.43 | 55.25 | 947 | 1,288 | Pass | |
| | 6 | | | 90.74 | 61.87 | 1,176 | 1,599 | Pass | |
| | 7 | | | 102.67 | 70.00 | 1,506 | 2,048 | FAIL | |
| 2 | 1 | 9.2 | 94 | 101.52 | 69.22 | 1,472 | 2,002 | Pass | 1" × ¼" tear |
| | 2 | | | 95.15 | 64.88 | 1,293 | 1,758 | FAIL | in the bag |
| 3 | 1 | 9.2 | 94 | 103.20 | 70.36 | 1,521 | 2,069 | Pass | 1" × 2" tear |
| | 2 | | | 95.60 | 65.18 | 1,306 | 1,776 | Pass | |
| | 3 | | | 98.62 | 67.24 | 1,389 | 1,889 | Pass | |
| | 4 | | | 113.12 | 77.13 | 1,828 | 2,486 | Pass | |
| | 5 | | | 121.51 | 82.84 | 2,109 | 2,864 | Pass | |
| | 6 | | | 123.46 | 84.17 | 2,177 | 2,961 | FAIL | |
| 4 | 1 | 9.2 | 94 | 124.53 | 84.91 | 2,215 | 3,012 | FAIL | 2" × ¾" tear |
| 5 | 1 | 9.2 | 94 | 124.07 | 84.59 | 2,199 | 2,991 | FAIL | Interior GDT 1" × 3" tear |
| 6 | 1 | 9.2 | 94 | 123.15 | 83.96 | 2,167 | 2,947 | FAIL | Interior GDT 1" × 2" tear |
| 7 | 1 | 9.2 | 94 | 125.31 | 85.44 | 2243 | 3,050 | Pass | Interior GDT |
| | 2 | | | 118.62 | 80.88 | 2,010 | 2,734 | Pass | 1" × 2" tear |
| | 3 | | | 128.70 | 87.75 | 2,366 | 3,218 | FAIL | |
| 8 | 1 | 9.2 | 96 | 141.64 | 96.57 | 2,866 | 3,898 | FAIL | 2" × 3" tears |
| | 2 | | | 137.55 | 93.78 | 2,703 | 3,676 | FAIL | after each |
| | 3 | | | 125.63 | 85.66 | 2,255 | 3,067 | FAIL | impact |
| 9 | 1 | 9.2 | 96 | 122.25 | 83.35 | 2,135 | 2,904 | Pass | ½" × 4" tear |
| | 2 | | | 123.30 | 84.06 | 2,172 | 2,954 | FAIL | |
| 10 | 1 | 9.2 | 96 | 117.51 | 80.12 | 1,973 | 2,683 | Pass | Interior GDT |
| | 2 | | | 119.79 | 81.68 | 2,050 | 2,788 | Pass | 1" × 2" tear |
| | 3 | | | 118.06 | 80.50 | 1,991 | 2,708 | FAIL | |
| 11 | 1 | 9.2 | 96 | 120.48 | 82.15 | 2,074 | 2,821 | FAIL | 1" × 1.5" tear |

Therefore, the foregoing is considered as illustrative only of the principles of the invention. Further, various modifications may be made of the invention without departing from the scope thereof and it is desired, therefore, that only such limitations shall be placed thereon as are imposed by the prior art and which are set forth in the appended claims.

What is claimed is:

1. A debris shield comprising at least two layers, one layer being an abrasion resistant woven fabric, and another layer comprising a single-weave three-dimensional, plain 4-layer tubular weave fabric comprising a plurality of intertwined tubular structures and having no more than about a 10% compression at a load of 20 pounds/inch$^2$.

2. The debris shield as claimed in claim 1, wherein the three-dimensional fabric comprises yarns having a size between about 500 denier and about 5,000 denier.

3. The debris shield as claimed in claim 1, wherein the three-dimensional fabric comprises shrink yarns having a size in a range between about 150 denier and about 1,800 denier.

4. The debris shield as claimed in claim 1, wherein the three-dimensional fabric comprises shrink yarns having a size in a range between about 200 and about 1,800 denier.

5. The debris shield as claimed in claim 1, wherein the three-dimensional fabric comprises a thickness between about 150 mils and about 1,200 mils.

6. The debris shield as claimed in claim 1, wherein the three-dimensional fabric comprises a weight of about 18 ounces/yard$^2$.

7. The debris shield as claimed in claim 1, wherein the three-dimensional fabric comprises a weight of 16 ounces/yard$^2$±5 ounces/yard$^2$.

8. The debris shield as claimed in claim 1, wherein the three-dimensional fabric has a 10% compression at a load of 20 pounds/inch$^2$.

9. The debris shield as claimed in claim 1, wherein the three-dimensional fabric has a 10% compression at a load of 25 pounds/inch$^2$.

10. The debris shield as claimed in claim 1, wherein the three-dimensional fabric has no more than about a 10% compression at a load of 25 pounds/inch$^2$.

11. The debris shield as claimed in claim 1, wherein the three-dimensional fabric has no more than about a 10% compression at a load of 32 pounds/inch$^2$.

12. The debris shield as claimed in claim 1, wherein the three-dimensional fabric has no more than about a 25% compression at a load of 38 pounds/inch$^2$.

13. The debris shield as claimed in claim 1, wherein the three-dimensional fabric has no more than about a 50% compression at a load of 45 pounds/inch$^2$.

14. The debris shield as claimed in claim 1, wherein the three-dimensional fabric has no more than about a 10% compression at a load of 32 pounds/inch$^2$, no more than about a 25% compression at a load of 38 pounds/inch$^2$, and no more than about a 50% compression at a load of 45 pounds/inch$^2$.

15. The debris shield as claimed in claim 1, wherein the abrasion resistant woven fabric comprises a high abrasion resistant yarn.

16. The debris shield as claimed in claim 1, wherein the abrasion resistant woven fabric comprises a high abrasion resistant and high ultraviolet radiation resistant yarn.

17. The debris shield as claimed in claim 1, wherein the abrasion resistant woven fabric comprises polypropylene.

18. The debris shield as claimed in claim 1, wherein the abrasion resistant woven fabric has a thickness between about 50 mils and about 250 mils.

19. The debris shield as claimed in claim 1, wherein the abrasion resistant woven fabric has a thickness of at least 80 mils.

20. A protected geocontainer comprising: a geotextile container for receiving and retaining soil, water, or both soil and water, and a debris shield as claimed in claim 1 disposed over at least a portion of the geotextile container.

21. A debris shield comprising at least two layers, one layer being an abrasion resistant woven fabric, and another layer comprising a single-weave three-dimensional, plain 4-layer tubular weave fabric comprising a plurality of intertwined tubular structures and having no more than about a 10% compression at a load of 32 pounds/inch and an air flow of at least 700 cubic feet/minute.

22. The debris shield as claimed in claim 21, wherein the three-dimensional fabric has an air flow of at least 800 cubic feet/minute.

23. The debris shield as claimed in claim 21, wherein the three-dimensional fabric has an air flow of at least 900 cubic feet/minute.

24. The debris shield as claimed in claim 21, wherein the three-dimensional fabric has an air flow of at least 1,000 cubic feet/minute.

25. The debris shield as claimed in claim 21, wherein the three-dimensional fabric has a water flow between about 20 gallons per minute/foot$^2$ and about 350 gallons per minute/foot$^2$.

26. The debris shield as claimed in claim 21, wherein the three-dimensional fabric has a water flow of at least 200 gallons per minute/foot$^2$.

27. A protected geocontainer comprising: a geotextile container for receiving and retaining soil, water, or both soil and water, and a debris shield as claimed in claim 21 disposed over at least a portion of the geotextile container.

28. A debris shield comprising at least two layers, one layer being an abrasion resistant woven fabric and another layer comprising a single-weave three-dimensional, plain 4-layer tubular weave fabric comprising a plurality of intertwined tubular structures and having no more than about a 10% compression at a load of 32 pounds/inch, a water flow between about 20 gallons per minute/foot$^2$ and about 350 gallons per minute/foot$^2$, and an air flow of at least 750 cubic feet/minute.

29. The debris shield as claimed in claim 28, wherein the three-dimensional fabric has a water flow of at least 200 gallons per minute/foot$^2$ and an air flow of at least 800 cubic feet/minute.

30. A protected geo container comprising: a geotextile container for receiving and retaining soil, water, or both soil and water, and a debris shield as claimed in claim 28 disposed over at least a portion of the geotextile container.

31. A debris shield comprising at least two layers, one layer being an abrasion resistant woven fabric and another layer comprising a three-dimensional, plain 4-layer tubular weave fabric having an air flow of at least 750 cubic feet/minute, the debris shield having an impact resistance of at least 105 feet/second as measured in accordance with American Society for Testing and Materials International (ASTM International) Standards E1886-05 and E1996-12.

32. The debris shield as claimed in claim 31, wherein the debris shield has an impact resistance of at least 110 feet/second as measured in accordance with ASTM International Standards E1886-05 and E1996-12.

33. The debris shield as claimed in claim 31, wherein the debris shield has an impact resistance of at least 115 feet/second as measured in accordance with ASTM International Standards E1886-05 and E1996-12.

34. The debris shield as claimed in claim 31, wherein the debris shield has an impact resistance of at least 120 feet/second as measured in accordance with ASTM International Standards E1886-05 and E1996-12.

35. The debris shield as claimed in claim 31, wherein the debris shield has an impact resistance of at least 125 feet/second as measured in accordance with ASTM International Standards E1886-05 and E1996-12.

36. A protected geo container comprising: a geotextile container for receiving and retaining soil, water, or both soil and water, and a debris shield as claimed in claim 31 disposed over at least a portion of the geotextile container.

37. A debris shield comprising at least two layers, one layer being an abrasion resistant woven fabric, and another layer comprising a single-weave three-dimensional, plain 4-layer tubular weave fabric comprising polypropylene yarn and polyethylene yarn and having no more than about a 10% compression at a load of 20 pounds/inch$^2$.

38. A debris shield comprising at least two layers, one layer being an abrasion resistant woven fabric, and another layer comprising a single-weave three-dimensional, plain 4-layer tubular weave fabric comprising at least one shrink yarn and at least one non-shrink yarn and having no more than about a 10% compression at a load of 20 pounds/inch$^2$.

39. A debris shield comprising at least two layers, one layer being an abrasion resistant woven fabric, and another layer comprising a single-weave three-dimensional, plain 4-layer tubular weave fabric comprising non-shrink yarns having a size in a range between about 8 mils and about 30 mils and having no more than about a 10% compression at a load of 20 pounds/inch$^2$.

40. A debris shield comprising at least two layers, one layer being an abrasion resistant woven fabric, and another layer comprising a single-weave three-dimensional, plain 4-layer tubular weave fabric comprising 20 mil, round polypropylene yarn and 315 denier, round low density polyethylene monofilament and having no more than about a 10% compression at a load of 20 pounds/inch$^2$.

41. A debris shield comprising at least two layers, one layer being an abrasion resistant woven fabric, and another layer comprising a single-weave three-dimensional, plain 4-layer tubular weave fabric comprising a thickness of about 500 mils and having no more than about a 10% compression at a load of 20 pounds/inch$^2$.

* * * * *